US008146921B2

(12) United States Patent
Lombardi

(10) Patent No.: US 8,146,921 B2
(45) Date of Patent: Apr. 3, 2012

(54) BEER PONG ARCADE GAME METHOD AND APPARATUS

(76) Inventor: Michael Lombardi, Locust Valley, NY (US)

( * ) Notice: Subject to any disclaimer, the term of this patent is extended or adjusted under 35 U.S.C. 154(b) by 218 days.

(21) Appl. No.: 12/711,705

(22) Filed: Feb. 24, 2010

(65) Prior Publication Data

US 2011/0204570 A1 Aug. 25, 2011

(51) Int. Cl.

| | |
|---|---|
| ***A63B 67/00*** | (2006.01) |
| ***A63B 63/00*** | (2006.01) |
| ***A63B 71/04*** | (2006.01) |
| ***A63F 7/00*** | (2006.01) |
| ***A63F 7/30*** | (2006.01) |

(52) U.S. Cl. ..... 273/342; 273/400

(58) Field of Classification Search ..... 273/309, 273/342, 400–402, 317, 348; 473/496; D21/338, D21/341

See application file for complete search history.

(56) References Cited

U.S. PATENT DOCUMENTS

| | | | | |
|---|---|---|---|---|
| 7,325,807 | B1 | 2/2008 | Eason | |
| 7,516,960 | B1 | 4/2009 | Battiste | |
| 8,006,980 | B1 * | 8/2011 | Herro et al. | 273/342 |
| 8,028,995 | B2 * | 10/2011 | Hoffer | 273/342 |
| 2004/0188942 | A1 | 9/2004 | Trokan | |
| 2006/0027971 | A1 | 2/2006 | Radhakrishnan | |
| 2006/0226606 | A1 | 10/2006 | Finley et al. | |
| 2007/0107460 | A1 | 5/2007 | Webb et al. | |
| 2009/0194941 | A1 | 8/2009 | Boyd et al. | |
| 2010/0244384 | A1 * | 9/2010 | Hoffer | 273/342 |
| 2011/0204570 | A1 * | 8/2011 | Lombardi | 273/348 |

FOREIGN PATENT DOCUMENTS

WO WO2011105983 * 9/2011

* cited by examiner

*Primary Examiner* — Raleigh W. Chiu

(74) *Attorney, Agent, or Firm* — Tutunjian & Bitetto, P.C.; John G. Tutunjian

(57) ABSTRACT

A beer pong arcade game apparatus and methods of operation are described. Initially, a new round is started and out limit is set. For each shot, it is determined whether the player has successfully made the ball into one of the plurality of cups. If the user makes the ball into one of the cups, that cup is retracted below or flush with a surface. Alternatively, if the user fails to make the ball into one of the cups, the out limit is decremented. The game ends if the out limit reaches zero before the player manages to make all of the cups. However, if the player manages to make all cups before exceeding the out limit, then a new round is started with a new out limit and a new set of cups.

20 Claims, 9 Drawing Sheets

BEER PONG ARCADE GAME METHOD AND APPARATUS

BACKGROUND

1. Technical Field

The present principles relate to a beer pong related games and, more particularly, to a beer pong arcade game apparatus and methods of operation.

2. Description of the Related Art

The game of beer pong (also known as Beirut) is a popular party game, particularly among youths in college. Although there are many different variations of the game, the game typically involves two teams of two persons situated at opposite sides of a table. In front of each team is a collection of ten cups arranged in a bowling pin formation. The teams take turns shooting (i.e., tossing or bouncing) a ping pong ball with the goal of getting the ball into one of the cups at the opposite end of the table. Each time a player successfully gets a ball into a cup ("sinks" a cup), a player from the opposing team must drink the contents of that cup (which is usually alcohol, but does not have to be). If both members of a team successfully sink a cup on the same turn, then that team gets another turn to shoot (commonly referred to as "rollbacks"). The game typically ends when one team has made all ten cups. However, in some versions of the game, "rebuttal" rules will allow a team with no remaining cups an additional chance to sink the remaining cups of the opposing team and bring the game to overtime. Overtime consists of each team essentially starting a new game with only three cups. Overtime ends when one team has made all three cups and the opposing team fails to successfully "rebut".

The growing popularity of this game during recent years has resulted in a number of patent filings for beer pong game systems and apparatuses.

U.S. Pat. No. 7,516,960 to Battiste discloses an inflatable beer pong table apparatus. Both the table and the legs are inflatable, allowing for the easy transportation of the table. The table has a number of recesses which are sized and shaped to hold a number of cups. It is further disclosed that the table includes a cover for concealing the recesses.

U.S. Pat. No. 7,325,807 to Eason discloses another beer pong table that contains recesses for holding cups. The recesses in the table may be outfitted with plastic inserts which include a lip that extends slightly over the top of the table to prevent beer from spilling into the recesses. The inserts can be removed from the recesses to allow for easy rinsing.

U.S. Patent Application Publication No. 2007/0107460 by Webb discloses a cup holder for use in a beer pong game. The cup holder prevents cups from being knocked over during the game. It takes the form of a triangular tray which may include recesses for securing cups during the game of beer pong. Rubber or neoprene feet are located on the bottom of the tray to provide traction during use. It also includes a freezer pack which may be inserted into the tray for keeping the beverages in the cups cool.

U.S. Patent Application Publication No. 2004/0188942 by Trokan discloses a non-alcoholic beer pong game system. The system includes a plurality of colored beer pong balls having printed messages thereon. When a player successfully tosses a ball into one of the cups, a player from the opposing team must drink the contents of the cup and carry out the directions printed on the ball.

While prior art discloses a number of beer pong related gaming systems and apparatuses, the prior art fails to disclose the novel beer pong arcade game of the present invention.

SUMMARY

According to an aspect of the present principles, there is provided a beer pong arcade apparatus. The apparatus comprises a table with a set of cups grouped together at one end of the table. A cup retractor is included which is capable of lowering and raising the cups on the table after a user has successfully tossed or bounced a ball into one of the cups. The apparatus may further include a re-rack mechanism which causes the cup retractor to selectively raise and/or lower cups in order to arrange the cups in a particular configuration.

According to another aspect of the present principles, there is provided a method for operating a beer pong arcade game. The method includes the step of tossing or bouncing a ball into a cup. Successfully getting the ball into a cup results in that cup being retracted below or flush with the surface of the table. After the user has tossed/bounced the ball into a predetermined number cups, the cups can be automatically re-racked by pressing a button.

According to yet another aspect of the present principles, there is provided a method for operating a beer pong arcade game in a single player mode. At the outset, a predetermined number of allowed outs are provided to a user. The user attempts to toss or bounce a ball into one of a plurality of cups situated at the opposite end of a table. Each time a user fails to successfully toss or bounce a ball into one of the cups, an out is allocated to the user. If the user is able to sink all of the cups before exceeding the allotted number of outs, the user moves on to the next round in which the cups are reset and the user is allotted a reduced amount of allowed outs. However, if the user fails to sink all of the cups before the allotted out limit is exceeded in any round, the game ends.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1:
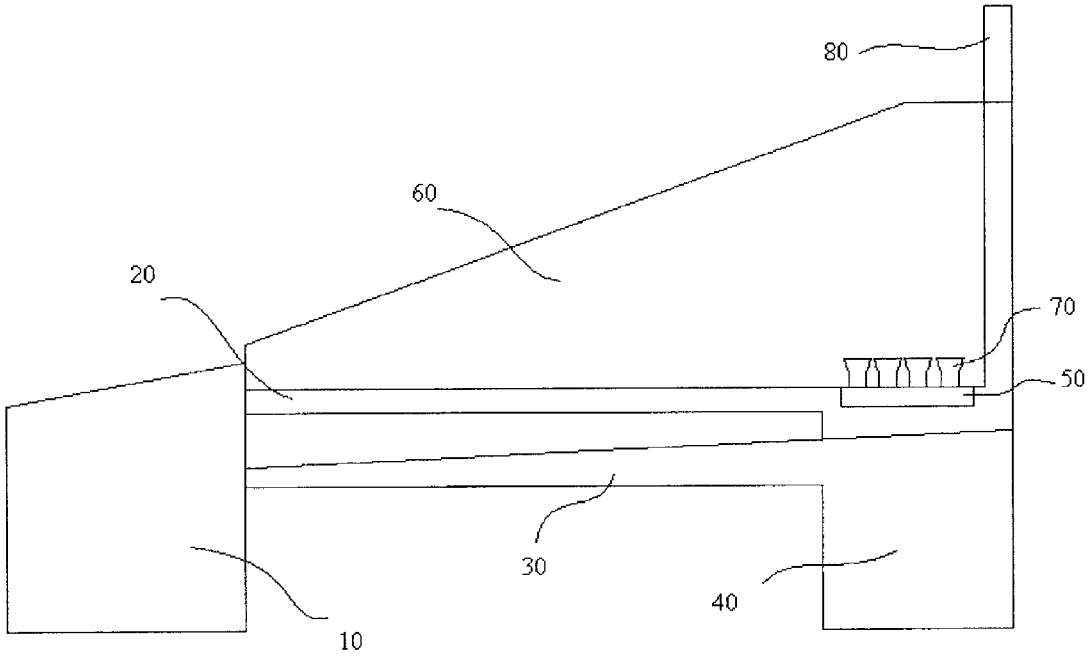
FIG. 1 is a side view of a beer pong arcade game in accordance with the present principles.

The description provided herein is directed to a beer pong arcade apparatus and methods of operation. The beer pong arcade apparatus comprises a table with a set of cups grouped together at one end of the table. The player(s) stands at the other end of the table and shoots (i.e., tosses or bounces) a ping pong ball with the goal of getting the ball into one of the cups. In one embodiment, if a user successfully shoots the ball into one of the cups, the ball passes through the bottom of the cup and is dropped onto a ramp. The ramp is sloped in order to assist with returning the ball to the player. Successfully getting a ball into one of the cups will also cause a retracting mechanism to pull the cup down into the playing field. This is accomplished in part by incorporating a "successful shot" sensing mechanism into the apparatus (in one of several ways, as explained below in further detail) which is capable of detecting when a player has successfully made the ball into a cup. The apparatus may also be outfitted with a "missed shot" sensing mechanism for detecting when a player has failed to successively toss or bounce a ball into one of the cups (also explained in further detail below).

The game can be operated in either a one player mode or a two player mode. In one player mode, the primary objective is to score as many points as possible. A player starts each round with a certain number allowed "outs" or misses. Each time a player tosses or bounces the ball, the missed shot sensing mechanism and/or the successful shot sensing mechanism can be used to determine whether the player has successfully made the ball into one of the cups. In one embodiment, the missed shot sensing mechanism and the successful shot sensing mechanism share common hardware (as explained in further detail below). Regardless of how the sensing mechanisms are configured, an out is subtracted each time it is determined that a player has missed a shot. On the other hand, if the user successfully sinks a cup, that cup will be retracted into the playing field. If the user manages to sink all ten cups in a round before running out of outs, then the user moves on to the next round where the out limit is reset and the player is provided with a new set of cups to sink. However, if the user runs out of outs before sinking all the cups in a round, then the game ends.

The game can also be operated in a two player mode, or a "head-to-head" mode. In head-to-head mode, the game may be played with two players facing off against each other or with two teams facing off against each other. The object of the game in two player mode is to successfully sink all of the cups before the other player or team does the same. In general, each team is given two shots before switching turns. However, if one team manages to make both shots in a single turn, then that team is provided with an additional two shots (referred to as "rollbacks"). The game is configured to automatically keep track of which cups have been sunk by each team. When the teams switch turns, the cup retractor can selectively raise and/or lower the cups in order to accurately reflect the current cup configuration for each team. When one team has made all of their cups, the game enters a "rebuttal mode" and players of the opposing team are given two outs to sink their remaining cups. If the opposing team does not manage to sink their remaining cups within the allotted two outs, the game ends. However, if the opposing team does manage to sink the remaining cups, the game goes to "overtime mode". In overtime, a new game is essentially started with only three cups per team. The game will end when one team has sunk all cups and the opposing team fails to hit the remaining cups in rebuttal mode. As will be described in further detail below, an out limit may be imposed in two player mode similar to the out limit imposed during single player mode.

Embodiments described herein may be entirely hardware, entirely software or including both hardware and software elements. In a preferred embodiment, the present invention is implemented in software, which includes but is not limited to firmware, resident software, microcode, etc.

Embodiments may include a computer program product accessible from a computer-usable or computer-readable medium providing program code for use by or in connection with a computer or any instruction execution system. A computer-usable or computer readable medium may include any apparatus that stores, communicates, propagates, or transports the program for use by or in connection with the instruction execution system, apparatus, or device. The medium can be magnetic, optical, electronic, electromagnetic, infrared, or semiconductor system (or apparatus or device) or a propagation medium. The medium may include a computer-readable medium such as a semiconductor or solid state memory, magnetic tape, a removable computer diskette, a random access memory (RAM), a read-only memory (ROM), a rigid magnetic disk and an optical disk, etc.

Figure 2:
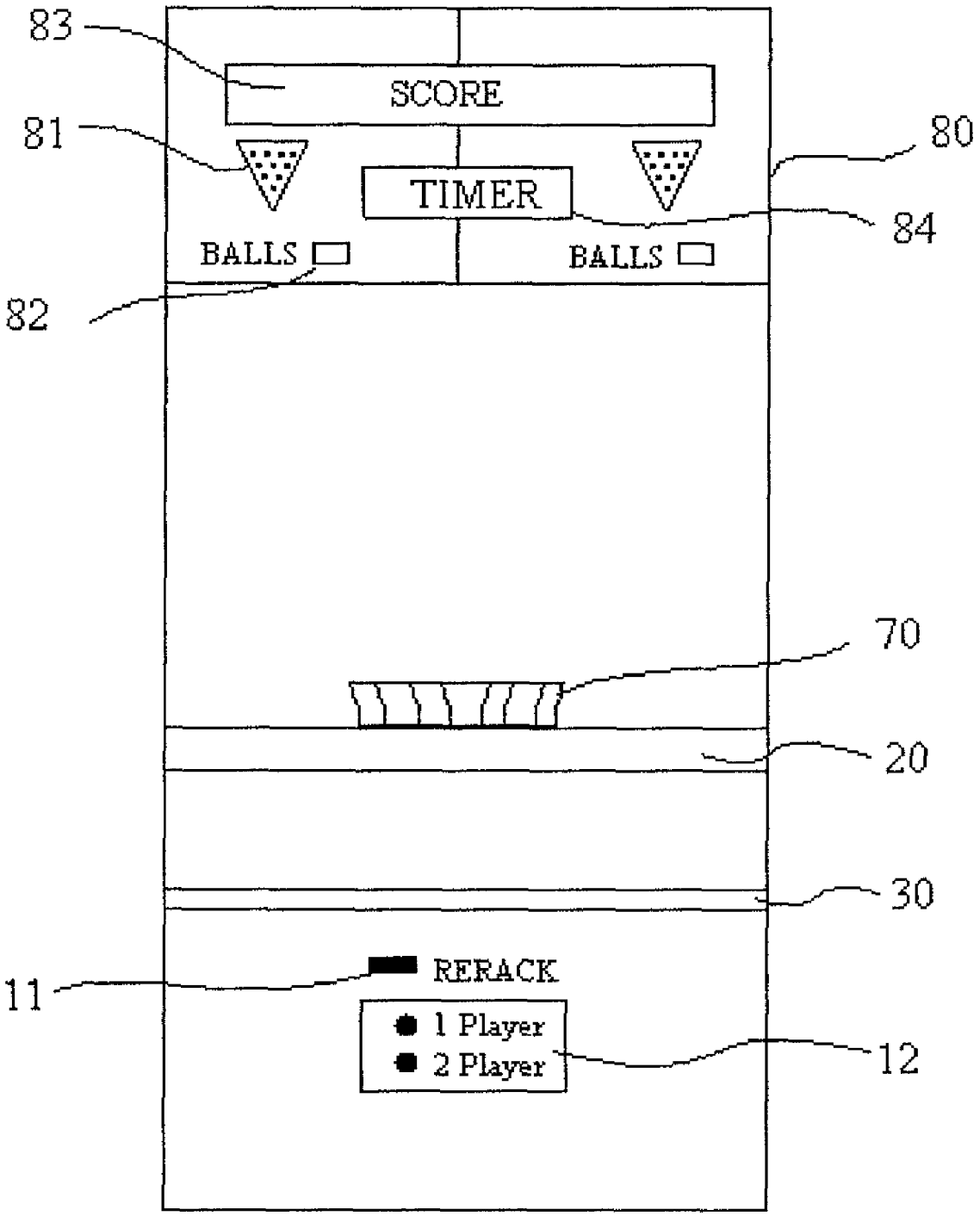
FIG. 2 is a front view of a beer pong arcade game in accordance with the present principles.

Referring to FIG. 1, a side view of a beer pong arcade game apparatus is illustratively shown. Players will generally stand in or near player area 10 and attempt to toss or bounce a ball into one of the cups 70. In an exemplary embodiment, the player area 10 is thirty inches long by thirty inches wide, and may be divided into two sections, 10A and 10B, one for each team. The player cabinet may also provide a number of input buttons to the user. For example, FIG. 2 provides a frontal view of the beer pong game apparatus and shows that a player may be provided with game selection buttons 12 which allow the user to select between one player/two player modes (or other modes), as well as a re-rack button 11 which will allow the user to rearrange the configuration of the cups as explained below. It should be noted that while the player area 10 is only outfitted with re-rack button 11 and game selection buttons 12 in the illustrative embodiment provided in FIG. 2, player area 10 may be outfitted with a variety of other controls including, but not limited to, a game reset button.

The game is typically played with ten cups 70 arranged like bowling pins (i.e., rows of 1-2-3-4) with the tops of the cups touching each other. In one embodiment, the cups have the same size and dimensions as typical sixteen ounce plastic Solo® cups that can be purchased in a grocery store. The cups are positioned on the playing field opposite the user.

The playing field or table top 20 sits atop base table 40 for support and is approximately sixty-six inches long according to one embodiment. This reflects the distance between the player area 10 and the end of table top 20. In one embodiment of the present invention, the playing field is preferably sloped to assist in returning the ball to the user after a missed shot. The playing field may also be surrounded by a "ball stopping" means 60 to prevent missed shots from bouncing astray. For instance, the playing field may be surrounded by a mesh net, a solid frame, or anything else which could prevent a ball from bouncing away from the arcade game apparatus.

Figure 3A:
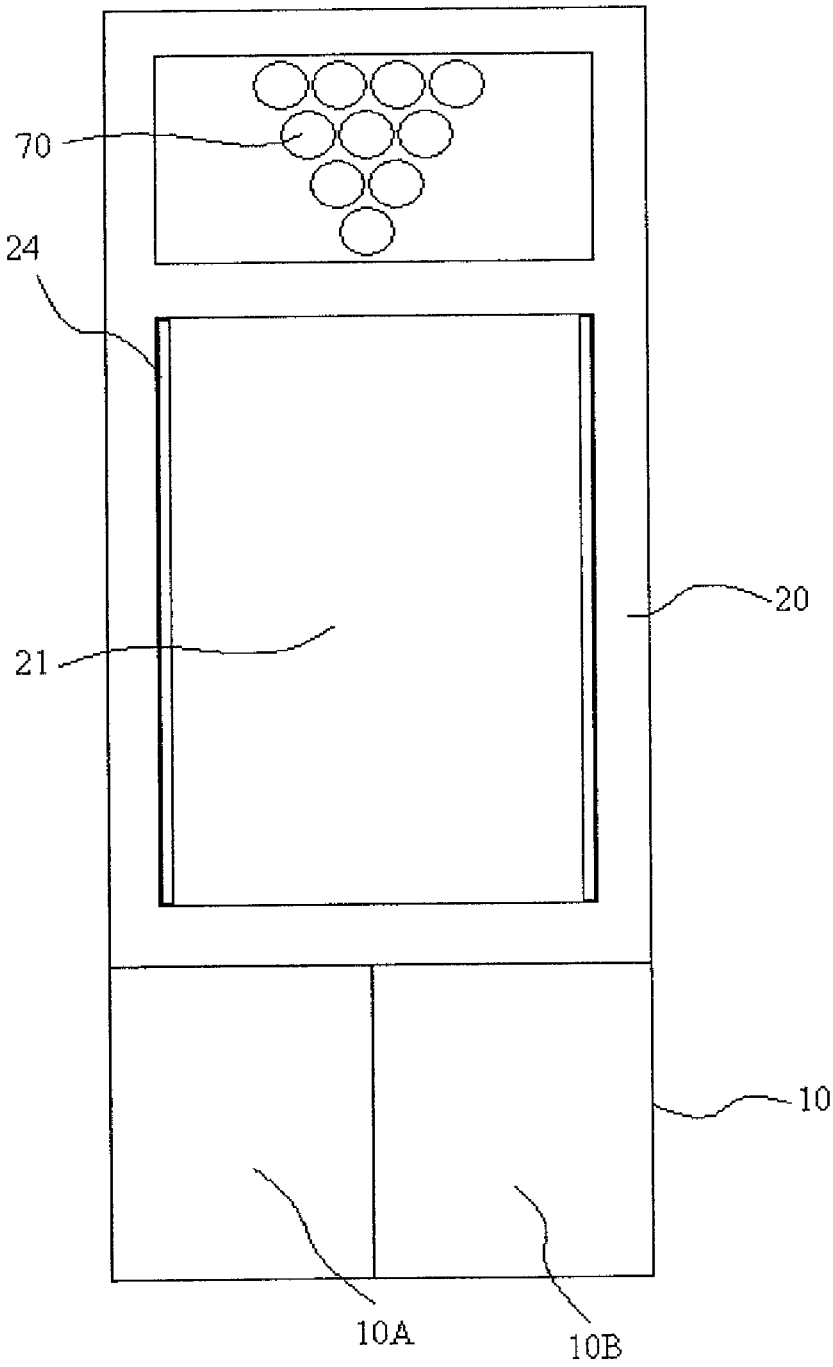
FIG. 3A is a top view of a beer pong arcade game in accordance with one embodiment of the present invention.

Referring to FIG. 3A, a top view of the beer pong arcade game apparatus is illustratively shown. In this particular embodiment, the playing field is outfitted with a bouncing surface 21 which will permit a user to bounce a ping pong ball into the cups 70 located at the far end of the table. This bouncing surface 21 is preferably made of a substance which is conducive to bouncing ping pong balls. The bouncing surface includes a pair of lights 24 which may alternate between two different colors in order to indicate which team is currently shooting.

In a preferred embodiment, when a user successfully tosses or bounces a ball into one of the cups 70, the ball passes through the bottom of the cup and is dropped onto return ramp 30 which rolls the ball back to the user. The return ramp preferably has a two and half inch slope for returning the ball to the user. Successfully tossing a ball into one of the cups 70 will also cause cup retractor mechanism 50 to automatically retract that cup below or flush with the surface of cup table 40.

Figure 4:
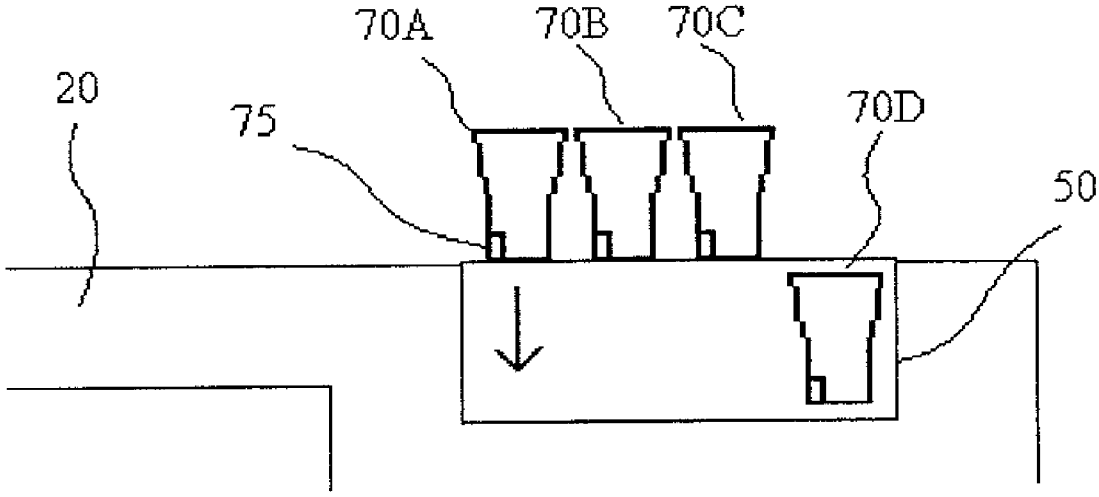
FIG. 4 is illustratively depicts an exemplary cup retractor for use with the present invention.

Referring to FIG. 4, a side view of an exemplary cup retractor 50 is illustratively shown. Cups 70A, 70B and 70C are positioned above the surface of table top 20. These cups represent "live" cups, that is, cups which have not been sunk by a player. If a player manages to toss or bounce a ball into a live cup, a "successful shot" sensing mechanism 75 associated with that cup will detect or sense the ball going into the cup, which will in turn cause the cup retractor 50 to retract the cup in the direction of the arrow. Cup 70D represents a cup which has been retracted. It should be recognized that a number of different sensing mechanisms and configurations can be utilized to detect when a player has successfully sunk a cup. For example, the sensing mechanism may be comprised of an infrared sensor, a contact sensor, a solenoid switch, a photoelectric sensor, a proximity sensor, etc. Regardless of which sensing mechanism is selected, the sensor should be configured to detect when a player has successfully sunk a cup. Depending upon the configuration of the sensing mechanism 75, it may be appropriate to deactivate the sensing mechanism 75 when the cup is in the retracted position.

Those that are familiar with the game of beer pong understand that sometimes a player may shoot a ball that comes very close to going into a cup, and even breaks the upper plane of the cup, but fails to actually drop into the bottom of the cup. Despite the fact that the ball has broken the upper plane of the cup, it should not be deemed that the player has sunk the cup. Therefore, in a preferred embodiment, the successful shot sensing mechanism is located near the bottom of the cup or even below the cup in order to ensure that only sunk cups are retracted. For instance, in one embodiment where the bottom of cups are hollowed out to allow for the passage of balls onto return ramp 30, a contact sensor is placed directly below the cup so that the sensor only detects balls which have actually passed through the cup. In another embodiment, an infrared, proximity or other motion detecting sensor is located on the inside, bottom portion of the cup (e.g., as shown in FIG. 4) so that the cup is only retracted when a ball has dropped a sufficient distance into the cup.

In addition to lowering cups which have been sunk, the cup retractor 50 may be further configured to assist with the re-racking or rearranging feature of the present invention. The "re-racking" or rearranging feature allows a player to adjust the configuration of the cups at certain points in the game. The regrouping of cups can be automatically done, or can be done manually by a player pressing a regroup or re-rack button 11. In a preferred embodiment, a player or team is provided with two re-racks per game and these re-racks can only be used when either six or three live cups remain in play (i.e. after four or seven cups have been sunk).

Figure 5A:
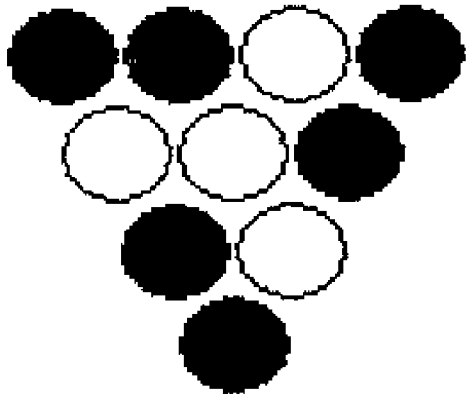
FIG. 5A is a top view of a random configuration of cups which have not been re-racked by the cup retractor of the present invention.
Figure 5B:
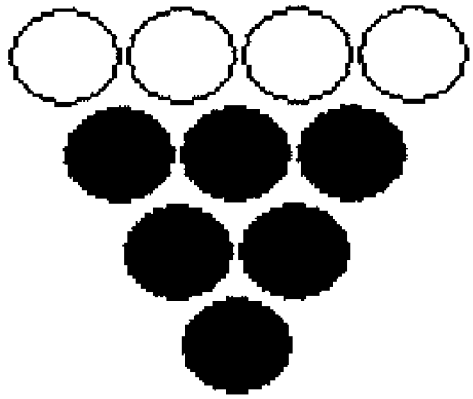
FIG. 5B is a top view of the cups in FIG. 5A after the cups have been re-racked by the cup retractor.

Referring to FIGS. 5A and 5B, an overhead view of two different cup configurations is provided in order to demonstrate how the cup retractor 50 can be used to re-rack or rearrange the cups 70. As explained above, a player will be permitted to re-rack the configuration of the cups after the player has sunk a predetermined number of cups. For instance, after the player has sunk four cups, the cups may be randomly configured as shown in FIG. 5A. At this point in the game, the player has the option to rearrange the cups by pressing re-rack button 11 (e.g., rearranging in rows of 1-2-3). Upon pressing the re-rack button, the remaining six cups will automatically be rearranged into a predetermined configuration, such as the one shown in FIG. 5B. The rearrangement of the cups as shown in FIG. 5B can be accomplished through the selective lowering and/or raising of cups by cup retractor 50. Thus, in order to achieve the triangle configuration shown in FIG. 5B, the cup retractor would be configured to lower the four cups in the back row and raise the other six cups in the front three rows. Although this example involves the rearrangement of six cups, it should be realized that the cup retractor can be configured to rearrange any number of cups into a wide variety of different configurations.

Figure 3B:
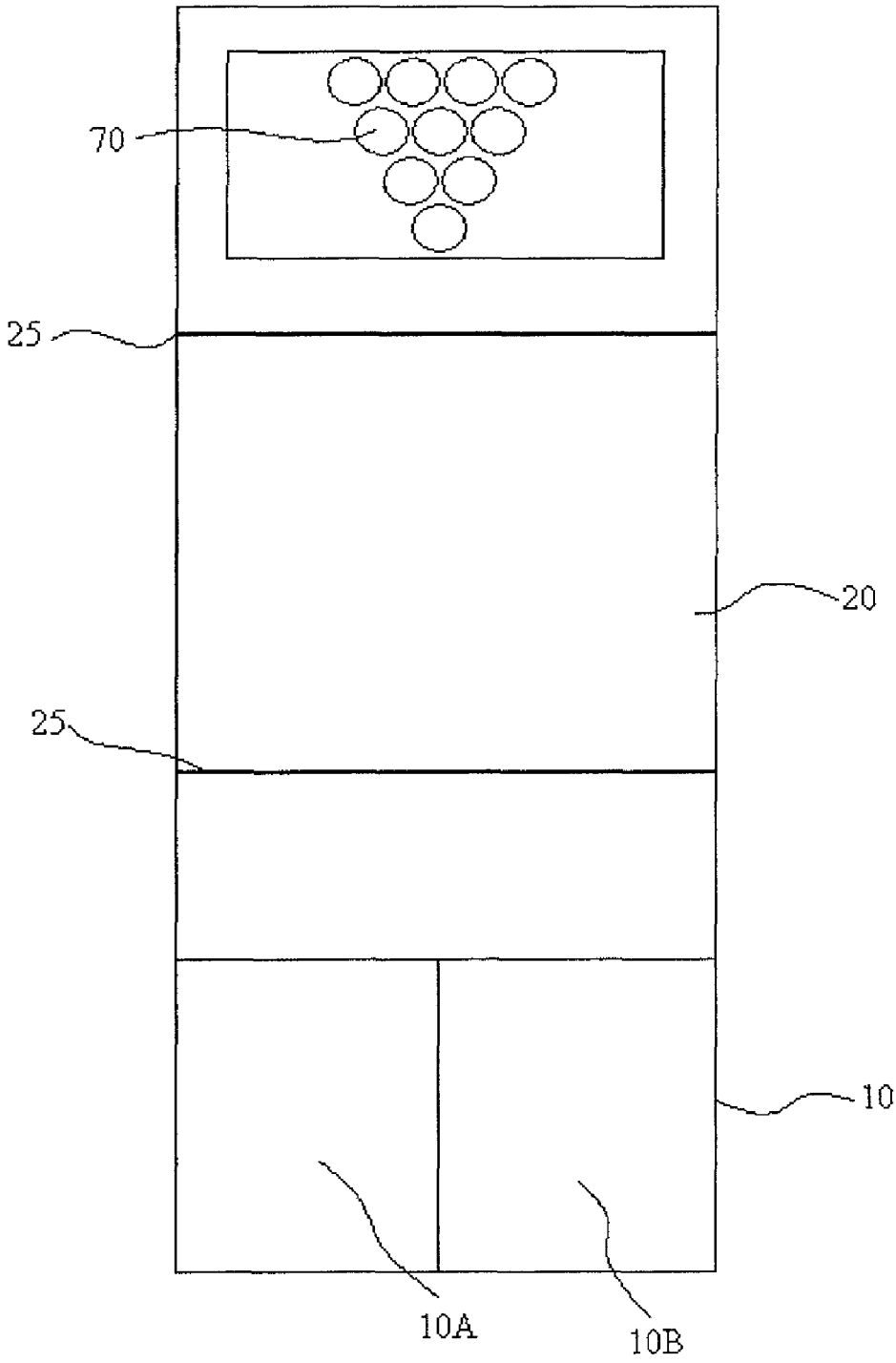
FIG. 3B is a top view of a beer pong arcade game in accordance with another embodiment of the present invention.

The beer pong arcade game apparatus also includes a "missed shot" sensing mechanism 25 for detecting when a user has failed to successfully toss or bounce a ball into one of the cups 70. In a preferred embodiment, the mechanism for detecting missed shots comprises a timer 84 that works in conjunction with the "successful shot" sensing mechanism 75 described above. For example, it may be determined that a player has missed a shot if the timer has expired before one of the sensors 75 in the cups 70 has detected a successful shot. In another embodiment, some part of the apparatus, such as the playing field, may be outfitted with a sensing mechanism 25 for detecting when a ball crosses over or near the sensor. For example, FIG. 3B shows an embodiment of the present invention where the playing field is outfitted with two sensing strips 25 which can detect a missed shot by determining that a ball has rolled over the sensing strips 25. In this embodiment, the playing field is preferably sloped at an angle in order to assist the ball in rolling over the sensing strips 25. In an even further embodiment, the mechanism for detecting missed shots may involve the incorporation of sensors into the arcade apparatus which can detect a transmitter device inside the ball. Thus, upon shooting the ball with the transmitter, a sensing means on the arcade game apparatus would be able to detect the location of the ball and determine whether the player has missed a shot. This determination may be made in conjunction with the successful shot mechanism. As can be seen, a wide variety of different sensing mechanisms and/or configurations can be utilized to detect missed shots. Moreover, it should be noted that the missed shot sensing mechanism may be implemented with a wide variety of different sensors (e.g., an infrared sensor, a contact sensor, a solenoid switch, a photoelectric sensor, a proximity sensor, etc.) just like the successful shot sensing mechanism.

The beer pong arcade game further includes a scoreboard 80, which can be seen in FIG. 2. In one embodiment, the scoreboard is thirty inches wide by fourteen inches high. The scoreboard 80 may include a number of different indicators. For example, the beer pong arcade apparatus illustrated in FIG. 2 has a score indicator 83 for indicating the score, a cup indicator 81 for indicating which cups have been sunk, a ball indicator 82 for indicating how many shots a player or team has left in a particular turn, and a timer 84. The scoreboard may also include an out indicator or ball counter (not shown) which counts down from a predetermined number and reflects the number of outs remaining for a player or team in a given round.

As briefly mentioned above, game selection buttons 12 allow a player to select whether the game will be operated in either a one player mode or a two player mode. In one player mode, the primary objective is to score as many points as possible. A ball counter or out indicator is reset to a predetermined number at the beginning of each round in order to specify the number of allowed "outs" or missed shots a player is provided with in a given round. Each time a player tosses or bounces the ball and fails to get the ball into one of the cups, the ball counter is decremented by one. If the user successfully sinks all ten cups in a round before exceeding the number of outs provided, then the user moves on to the next round. At the beginning of each new round, the ball counter is reset. In addition, the number of allowed outs for each round decreases as the game progresses. For example, a user may be given twenty outs in the first round, which would essentially mean that the user is allowed to miss twenty times in that round before the game is over. If the user sinks all of the cups on the table before exceeding the out limit, the user moves on to round two where he or she may only be given fifteen outs.

As stated above, the primary objective in one player mode is to score as many points as possible. The user scores points by tossing or bouncing the ball into the cups 70. Bonus points may be awarded for a number of reasons. For instance, users may be awarded an "unused re-rack bonus" or an "unused out bonus" for any unused outs and/or unused re-racks remaining at the end of a round. Likewise, "consecutive ball bonuses" may be awarded to a player who consequently sinks a predetermined number of cups in a row.

Figure 6:
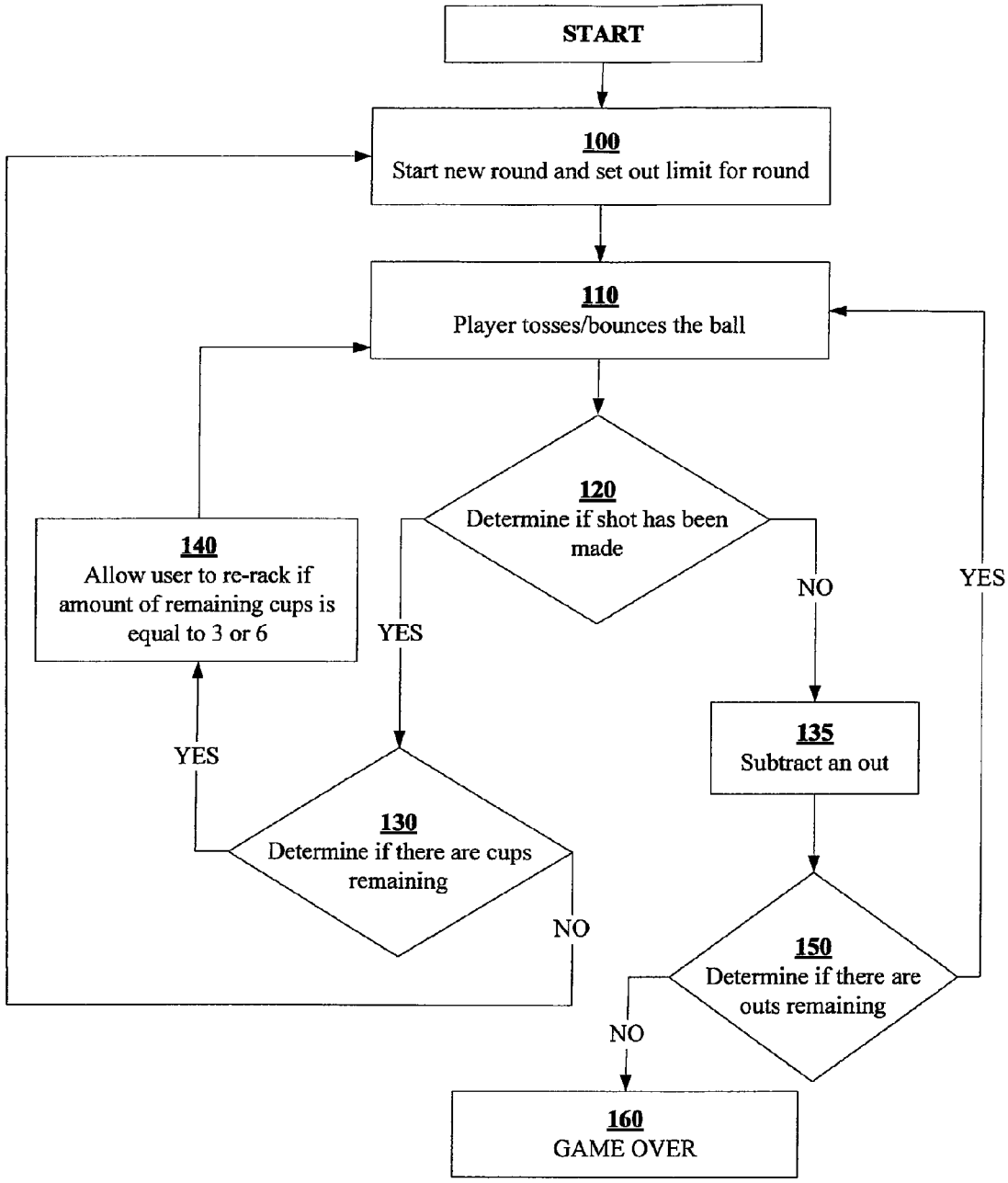
FIG. 6 is a block/flow diagram illustrating a method for operating a beer pong arcade game apparatus in single player mode.

Referring to FIG. 6, a detailed method for operating a beer pong arcade game apparatus in single player mode is illustratively shown in accordance with one embodiment of the present invention. The method begins at the start block and proceeds to block 100 where a new round is started and an out limit is set for the user. It should be noted that the number of outs provided to the user will vary depending upon the round. After the game is initiated and the out limit is set, the player is provided with a ping pong ball or balls at block 110. Each time the player shoots the ball, it must be determined whether the shot has been made (block 120). This may be accomplished using the missed shot sensing mechanism, the successful shot sensing mechanism, or any combination thereof as described above.

If the player has failed to make the shot at block 120, an out is subtracted from the player at block 135. At this point, it must be further determined whether the there are any outs remaining (block 150). If there are remaining outs, the game jumps back to block 110 where the ball is provided to the player in order to allow the player to take another shot. However, if it is determined that there are no remaining outs after the player has missed a shot, then the game ends (block 160). In this case, the player may have the option to continue the game for more credits.

Alternatively, if it is determined that the player has made the previous shot at block 120, the games progresses to block 130 where a further inquiry is made as to whether there are any remaining cups. If it is determined that there are remaining cups (i.e. live cups) on the table, a check is performed at block 140 to determine whether the user is able to re-rack the cups. The game may be configured to automatically re-rack the cups or, alternatively, may be configured to only re-rack cups when a player has pressed the re-rack button 11. In a preferred embodiment, cups may only be re-racked when there are three or six cups remaining and a player has pressed the re-rack button 11. Regardless of whether the player is permitted to re-rack the cups, the player is once again provided with the ball and the game reverts back to block 120. On the other hand, if it is determined that there are no remaining cups after the user has made the previous shot, this indicates that the user has completed the round. Therefore, the method would proceed from block 130 to block 100 where a new round is started. Upon initiation of a new round, a new out limit and new set of cups is provided.

The beer pong arcade game apparatus of the present invention can also be operated in a two player mode, or a "head-to-head" mode. In head-to-head mode, the game may be played with two players facing off against each other, or with two teams facing off against each other. In general, each team or player is given two shots per turn before the other team gets a chance to shoot. However, if a team makes both shots in a single turn, then the team gets the balls back and is given an additional two throws. This situation is commonly referred to as "rollbacks." Given the nature of rollbacks, it is possible that one team may sink all ten cups 70 before the other team has even had a chance to shoot a ball.

The beer pong arcade of the present invention is configured to automatically keep track of which cups have been sunk by each team. This may be accomplished by implementing a tracking mechanism which can compile and store tracking information which reflects, inter alia, the number of cups each team has sunk and the particular configuration of cups which should be provided during each team's turn. In one embodiment, the tracking mechanism is implemented as part of the cup retractor. Thus, when the teams switch turns, the cup retractor 50 can be selectively raise and/or lower the cups 70 in order to accurately reflect the current cup configuration for each team. For example, suppose that after a few turns, "team one" has sunk the four cups in the back row, while "team two" has only sunk the front cup in the first row. As the teams switch turns, the cup retractor 50 will automatically switch the configuration of the cups to reflect the proper configuration for that team. Thus, when it is team one's turn, the cup retractor will lower the cups in the back row and raise the remaining cups. Alternatively, if it is team two's turn, the cup retractor lower the front cup and raise the remaining cups.

The object of the game in two player mode is to successfully sink all of your cups before the other player or team does the same. However, a team which sinks all of the cups does not automatically win. Once a team has no remaining cups left, the opposing team is allowed one "rebuttal" turn. The additional rebuttal turn gives the opposing team two additional outs to sink the rest of their remaining cups. If the opposing team is not able to sink the rest of their cups before using the extra two outs provided, then the opposing team loses. However, if the opposing team is able to sink the remaining cups before using up the additional two outs, then the game goes to "overtime."

Overtime essentially consists of starting a new game with only three cups. Once a team has sunk all three cups, the opposing team is once again given a rebuttal turn which would allow that team to push the game to a second overtime. Thus, there may be multiple overtime time rounds in a single game. Overtime will end when one team has sunk all three cups and the opposing team fails to successfully "rebut".

It should be noted that games in two player mode may include an out limit similar to the limit imposed in one player mode. As explained above, a game in two player usually ends when one team sinks all of their cups and the opposing team has an unsuccessful rebuttal round.

However, the game may alternatively end if the out limit is exceeded. Thus, if neither team is able to sink all of the cups within the allotted number of outs provided (preferably forty outs during normal game play and ten outs for each overtime round), the game is over and the winner is decided by which team has sunk the most cups. If both teams have hit the same amount of cups, then the game results in a tie. Users may be given the option to continue their game for more credits if neither team has hit all of the cups on the table.

Figure 7A:
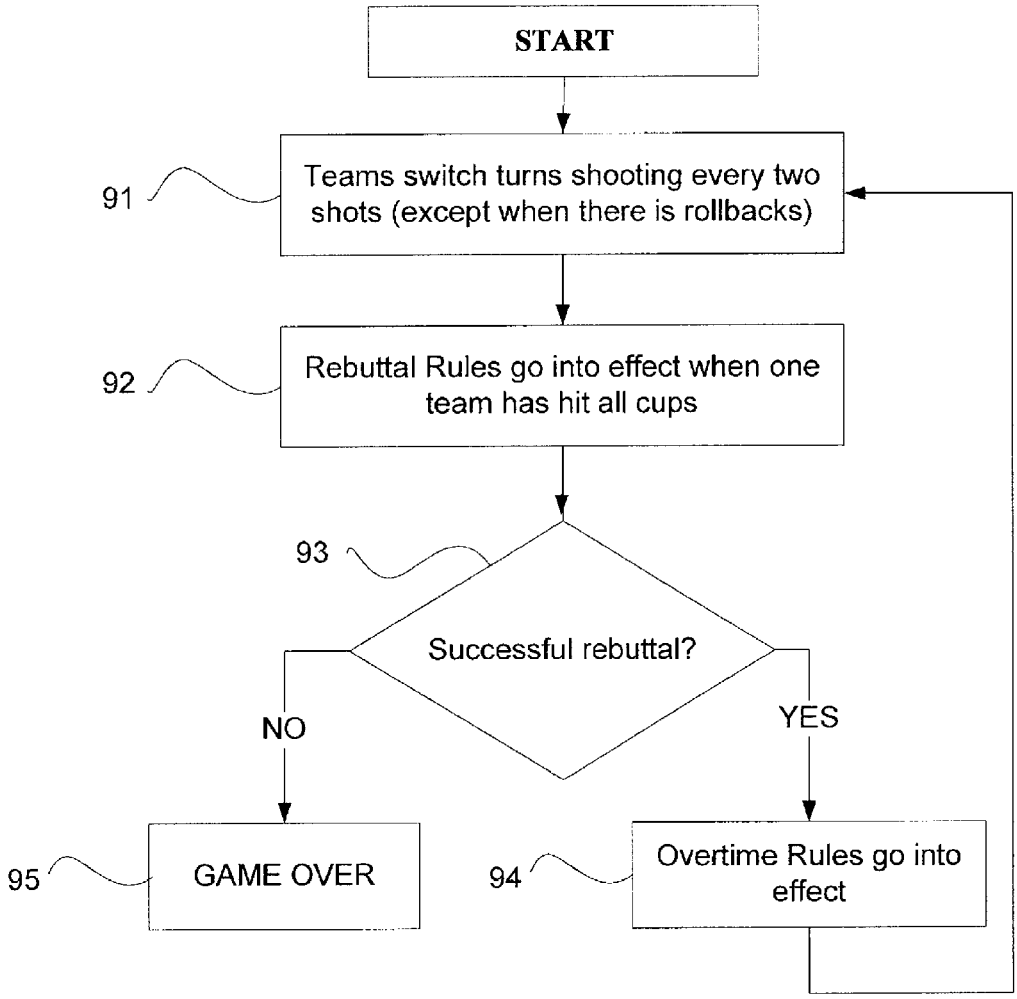
FIG. 7A is a block/flow diagram illustrating a general method for operating a beer pong arcade game in two player mode.

Referring to FIG. 7A, a block/flow diagram discloses a general method for playing a beer pong arcade game (without an out limit). The method starts at the start block at proceeds to block 91. In block 91, teams switch turns shooting every two shots. However, if one team makes both shots in a single turn, then that team gets another two chances to shoot the ball (i.e., rollbacks). After one team has managed to sink all of the cups on the table, the game proceeds to block 92 where rebuttal rules go into effect and the opposing team is given a chance to sink the remaining cups on the table. A check is performed in block 93 to determine whether the rebutting team was able to successfully make the remaining cups. If it is determined at block 93 that the rebutting team has failed to sink the remaining cups, then the game ends (block 95). Alternatively, if it is determined that the rebutting team has sunk the remaining cups, the game proceeds to block 94 where overtime rules go into effect. In overtime, the game is played as it is during normal game play except for the fact that the game is played with a limited number of cups (typically three cups). After one team has sunk all of the cups in overtime, the other team is once again given a chance to sink the remaining cups (block 92) and bring the game to a second overtime. The game will continue like this until one team has hit all of the cups and the other team has failed to successfully rebut.

Figure 7B:
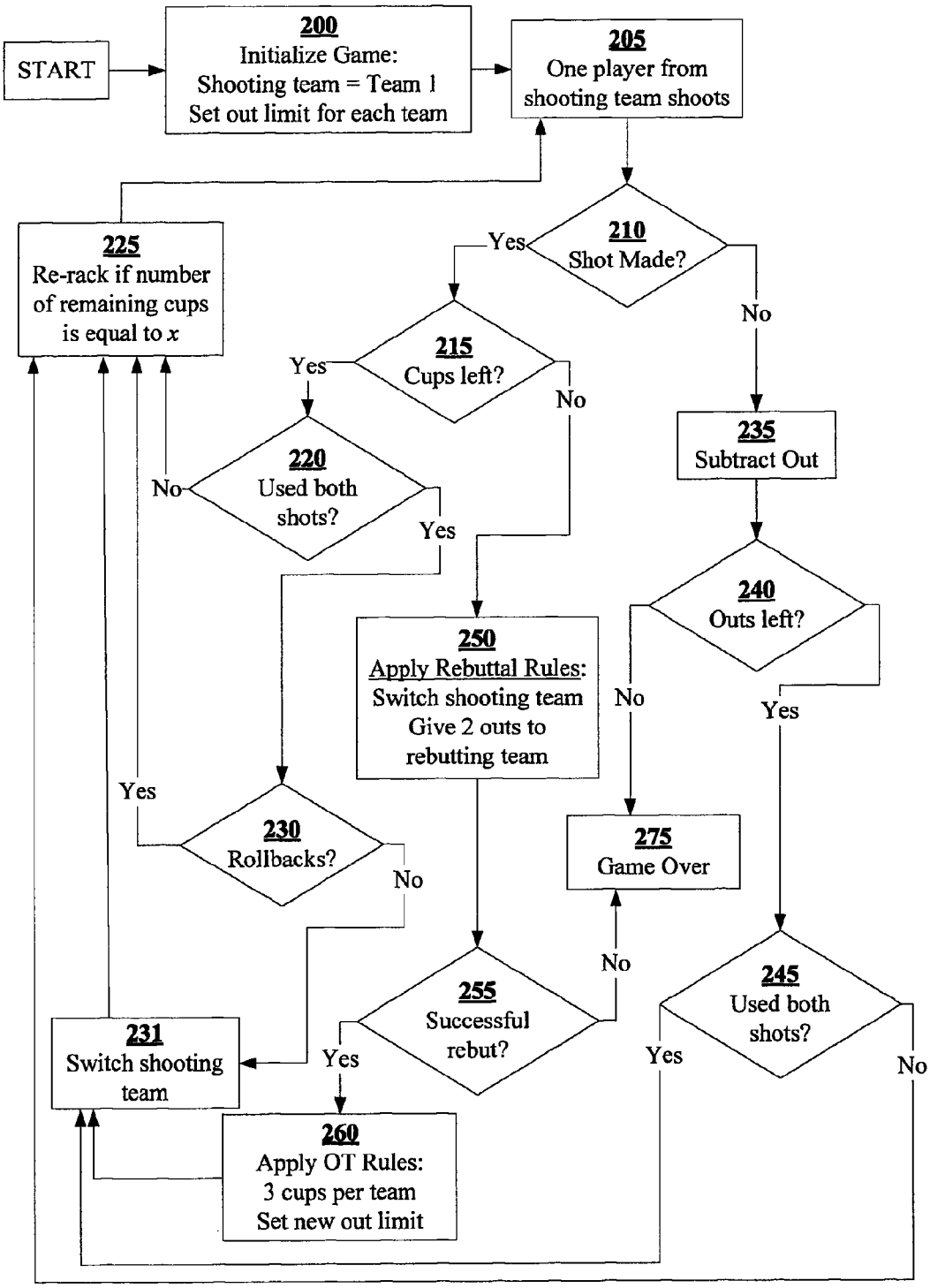
FIG. 7B is a block/flow diagram illustrating a more detailed method for operating a beer pong arcade game in two player mode which includes an out limit.

A more detailed method for operating a two player beer pong game is disclosed in FIG. 7B. The method disclosed here includes imposes an out limit and provides a re-racking option. The two player game begins at the start block and proceeds to block 200 where the game is initialized. During initialization, an out limit is set for each team and an initial "shooting team" is selected. The "shooting team" reflects which team is currently shooting. In a preferred embodiment, team one is selected as the initial shooting team and forty outs are allotted to each team. After the initialization step, the game proceeds to block 205 where a player from the shooting team attempts to toss or bounce a ball into the cups 70. After each shot, it must be determined whether the shooting team was able to successfully get the shot into one of the cups (block 210).

If it is determined at block 210 that the previous shot was not successful, an out is subtracted from the shooting team (block 235). After an out has been subtracted, decision block 240 determines whether the shooting team has any outs remaining. If the shooting team has no outs remaining, the game ends (block 275). It should be noted that the game will immediately end when one team reaches their out limit, regardless of how many outs the other team has remaining. On the other hand, if the shooting team has remaining outs left, the game proceeds to block 245 where a check is performed to determine whether the team has used both shots for the current turn. Assuming the shooting team has only shot once, a re-rack check is performed (block 225) before the team is permitted to shoot again (block 205). It should be noted that whenever the re-rack check is performed in block 225, the game can be configured to automatically re-rack the cups if it is determined that the number of remaining cups is equal to a predetermined number (for example, three or six). Rather than automatically re-racking the cups, the game can be alternatively be configured such that the re-rack button 11 becomes activated if the number of remaining cups is equal to the predetermined number, thus allowing the shooting team to re-rack the cups by pressing the re-rack button 11.

In the alternate situation where it is determined that the shooting team has already shot twice at block 245, the teams should switch turns (e.g., team two becomes the shooting team). Therefore, the game proceeds from block 245 to block 231 where the shooting team is switched. Each time the shooting team is switched at block 231, the cup retractor 50 will automatically adjust the configuration of the cups for the shooting team. Before allowing the newly switched team to shoot at block 205, a check is performed to determine whether that team is entitled to re-rack the cups (block 225).

If at any time it is determined at block 210 that the previous shot was made, a further inquiry is made at block 215 as to whether the shooting team has any remaining cups to sink. If there are cups left to sink, the game proceeds to block 220 where it an additional determination is made as to whether the team has used both shots for the current turn. If both shots have not been used, a re-rack check is performed (block 225) and the shooting team is allowed to shoot again (block 205). Alternatively, if it is determined at block 220 that the shooting team has used both shots, then an additional check is performed to determine whether the shooting team is entitled to "rollbacks" (i.e., whether the team has made both shots) at block 230. If the shooting team has made both shots, a re-rack check is performed at block 225 and the team gets another two chances to shoot (block 205). Otherwise, the game proceeds to block 231 where the shooting team is switched. Upon switching the shooting team, a re-rack check is performed (block 225) and the newly switched team gets to shoot (block 205).

Alternatively, if a shot has been made and it is determined that the shooting has no remaining cups left to sink at block 215, the game proceeds to block 250 where rebuttal rules go into effect. Application of the rebuttal rules in block 250 involves switching the shooting team so that the team that still has remaining cups is given a chance to tie the game and bring it to overtime. The shooting team must sink the remaining cups before exceeding the two allotted outs in order do so. At block 255, a check is performed to determine whether the rebutting team has successfully made the remaining cups within the allotted two outs. If the rebutting team has failed to sink the remaining cups, the game ends (block 275). Otherwise, the game proceeds to block 260 where overtime rules are applied.

As mentioned above, overtime rules essentially consist of starting a new game with only reduced amount of cups and a reduced out limit. In a preferred embodiment, overtime is played with three cups and ten outs are provided to each team. Also, in overtime, the shooting team should be switched to the team that was first to sink all of the cups during normal game play (block 231). After establishing overtime rules, the game would jump back to block 205 where the game would proceed according to normal game play rules. Although a re-rack check is performed at block 225 before proceeding to block 205, this check is extraneous and may be skipped.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A method for playing a single-player beer pong game, comprising the steps of:

setting an out limit which represents a maximum number of times a player may unsuccessfully toss or bounce a ball into one of a plurality of cups situated above a surface;

determining whether the player has successfully made the ball into one of the plurality of cups each time the player tosses or bounces the ball;

retracting one of the plurality of cups below or flush with the surface each time it is determined that the player has successfully made the ball into one of the plurality of cups; and decrementing the out limit each time the player fails to make the ball into one of the plurality of cups.

2. The method of claim 1, further comprising the step of determining whether the player has successfully made the ball into each of the plurality of cups before the out limit has reached zero.

3. The method of claim 2, wherein the determination as to whether the player has successfully made the ball into one of the plurality of cups is made by at least one of:

a first sensing mechanism located in or beneath the plurality of cups;

a second sensing mechanism located on the surface; or an expiration of a timer mechanism.

4. The method of claim 3, wherein the first sensing mechanism or the second mechanism is comprised of at least one of an infrared sensor, a contact sensor, a solenoid switch, a photoelectric sensor, or a proximity sensor.

5. The method of claim 2, further comprising the step of establishing a new round if it is determined that the player has successfully made the ball into each of the plurality of cups before the out limit has reached zero.

6. The method of claim 1, further comprising permitting the plurality of cups to be re-racked after a successful shot if is determined that the number of remaining cups for that team is equal to a predetermined number.

7. The method of claim 6, wherein the plurality of cups are re-racked in response to the player pressing a re-rack button.

8. The method of claim 1, wherein the plurality of cups is comprised of ten cups arranged in a bowling pin formation.

9. A method for playing a beer pong game with a first team and a second team, comprising the steps of:

permitting both a first team and a second team to shoot a ball at a plurality of cups situated above a surface, wherein the first team and the second team switch turns shooting the ball in a predetermined manner;

determining for each shot whether the ball was successfully tossed or bounced into one of the plurality of cups;

updating tracking information after each shot, wherein the tracking information comprises information regarding the current cup configuration for each team; and altering the cup configuration in accordance with the tracking information wherever the teams switch turns by selectively raising and lowering the plurality of cups.

10. The method of claim 9, further comprising the step of determining which team was first to successively sink each of the plurality of cups.

11. The method of claim 9, wherein the determination as to whether the ball was successfully tossed or bounced into one of the plurality of cups is made by at least one of:

a first sensing mechanism located in or beneath the plurality of cups;

a second sensing mechanism located on the surface; or an expiration of a timer mechanism.

12. The method of claim 11, wherein the first sensing mechanism and the second mechanism are comprised of at least one of a infrared sensor, a contact sensor, a solenoid switch, a photoelectric sensor, or a proximity sensor.

13. The method of claim 9, further comprising the step of re-racking the plurality of cups for either team if is determined that the number of remaining cups for that team is equal to a predetermined number.

14. The method of claim 9, wherein the game further comprises assigning an out limit to each team which reflects a maximum number of times each team may unsuccessfully toss or bounce a ball into one of a plurality of cups before the game is over.

15. The method of claim 9, wherein the plurality of cups is comprised of ten cups arranged in a bowling pin formation.

16. The method of claim 9, wherein the predetermined manner for switching turns comprises rotating turns every two shots except when a team has made both shots in a single turn.

17. An beer pong game apparatus, comprising:

a plurality of cups situated atop a surface;

a cup retractor configured to raise and lower each of the plurality of cups below or flush with the surface;

a first sensing mechanism configured to detect whether a ball has gone into one of the plurality of cups; and a second sensing mechanism configured to detect whether the ball has failed to go into one of the plurality of cups.

18. The apparatus of claim 17, wherein the cup retractor is further configured to rearrange a configuration of the plurality of cups by selectively raising and lowering the plurality of cups in a predetermined manner.

19. The apparatus of claim 17, wherein the apparatus further comprises a sloped return ramp for returning a ball to a user.

20. The apparatus of claim 17, wherein the apparatus further comprises game selection buttons which allow a user to select whether the apparatus is operated in one player mode or two player mode.

* * * * *